US009731177B2

(12) United States Patent
Sandoval et al.

(10) Patent No.: US 9,731,177 B2
(45) **Date of Patent: *Aug. 15, 2017**

(54) GOLF CLUB HEAD

(71) Applicant: SRI SPORTS LIMITED, Kobe-shi, Hyogo (JP)

(72) Inventors: Michael D. Sandoval, La Palma, CA (US); Adam K. Sheldon, Long Beach, CA (US)

(73) Assignee: SRI SPORTS LIMITED, Kobe-shi (JP)

( * ) Notice: Subject to any disclaimer, the term of this patent is extended or adjusted under 35 U.S.C. 154(b) by 160 days.

This patent is subject to a terminal disclaimer.

(21) Appl. No.: 14/086,488

(22) Filed: Nov. 21, 2013

(65) Prior Publication Data

US 2014/0080630 A1 Mar. 20, 2014

Related U.S. Application Data

(63) Continuation of application No. 13/188,145, filed on Jul. 21, 2011, now Pat. No. 8,617,001.

(51) Int. Cl.
*A63B 53/04* (2015.01)

(52) U.S. Cl.
CPC ..... *A63B 53/0487* (2013.01); *A63B 53/04* (2013.01); *A63B 53/047* (2013.01); *A63B 53/0466* (2013.01); *A63B 2053/042* (2013.01); *A63B 2053/0408* (2013.01); *A63B 2053/0416* (2013.01); *A63B 2053/0425* (2013.01); *A63B 2053/0429* (2013.01)

(58) Field of Classification Search
CPC ..... A63B 2053/0416; A63B 2053/042; A63B 2053/0425; A63B 2053/0429; A63B 53/007; A63B 53/0487
USPC ..... 473/324–350
See application file for complete search history.

(56) References Cited

U.S. PATENT DOCUMENTS 5,160,144 A * 11/1992 Maniatis ..... A63B 53/0487 473/234
D351,644 S * 10/1994 Jensen ..... D21/744
(Continued)

OTHER PUBLICATIONS

Nov. 2, 2012 Office Action issued in U.S. Appl. No. 13/188,145.
(Continued)

*Primary Examiner* — John E Simms, Jr.
(74) *Attorney, Agent, or Firm* — Oliff PLC

(57) ABSTRACT

A golf club head has a main body including a top portion, a bottom portion opposite the top portion, a striking face, a rear portion opposite the striking face. The striking face has a striking face plane and a striking face outer periphery that is coplanar with the striking face plane. The striking face outer periphery has an outer periphery heel portion, an outer periphery toe portion opposite the outer periphery heel portion, an outer periphery top portion, and an outer periphery bottom portion opposite the outer periphery top portion. The striking face also has a recess extending rearward from the striking face plane, and the recess includes a recess periphery coplanar with the striking face plane. The striking face further has an insert disposed within the recess. The striking face additionally has a minimum periphery width separating the striking face outer periphery and the recess periphery. The periphery width is no greater than 1.25 mm.

16 Claims, 14 Drawing Sheets

(56) References Cited

U.S. PATENT DOCUMENTS

| | | | | |
|---|---|---|---|---|
| 5,823,244 | A | 10/1998 | Hseih | |
| 6,299,549 | B1 | 10/2001 | Shieh | |
| 6,517,448 | B1 | 2/2003 | Takeda | |
| 6,648,774 | B1 | 11/2003 | Lee | |
| 6,660,960 | B2 | 12/2003 | Takeda | |
| 6,777,640 | B2 | 8/2004 | Takeda | |
| 6,860,822 | B2 | 3/2005 | Vrska, Jr. | |
| 6,986,715 | B2 | 1/2006 | Mahaffey | |
| 7,018,305 | B2 | 3/2006 | Sugimoto | |
| 7,025,695 | B2 | 4/2006 | Mitsuba | |
| 7,066,834 | B2 | 6/2006 | Yamamoto | |
| 7,150,686 | B2 | 12/2006 | Mitsuba | |
| 7,175,540 | B2 | 2/2007 | Sano | |
| 7,431,665 | B2 | 10/2008 | Sugimoto | |
| 7,500,923 | B2 | 3/2009 | Tateno | |
| 8,617,001 | B2 * | 12/2013 | Sandoval | A63B 53/04 473/340 |
| 2005/0054462 | A1 * | 3/2005 | Breier | A63B 53/0487 473/332 |
| 2005/0090328 | A1 * | 4/2005 | Sano | A63B 53/0487 473/340 |
| 2006/0014593 | A1 | 1/2006 | Hou | |
| 2006/0118998 | A1 * | 6/2006 | Meacham | A63B 53/007 264/255 |
| 2007/0099723 | A1 | 5/2007 | Tateno | |
| 2007/0099725 | A1 | 5/2007 | Tateno | |
| 2010/0151960 | A1 | 6/2010 | Wahl et al. | |
| 2010/0273570 | A1 | 10/2010 | Ines et al. | |
| 2010/0311519 | A1 | 12/2010 | Treadwell | |

OTHER PUBLICATIONS

Jun. 6, 2013 Office Action issued in U.S. Appl. No. 13/188,145.

Aug. 21, 2013 Notice of Allowance issued in U.S. Appl. No. 13/188,145.

* cited by examiner

GOLF CLUB HEAD

CONTINUITY INFORMATION

This is a Continuation of application Ser. No. 13/188,145 filed Jul. 21, 2011. This prior application, including the specification, drawings and abstract, is incorporated herein by reference in its entirety.

COPYRIGHT AUTHORIZATION

The disclosure below may be subject to copyright protection. The copyright owner has no objection to the facsimile reproduction by any one of the documents containing this disclosure, as they appear in the Patent and Trademark Office records, but otherwise reserves all applicable copyrights.

BACKGROUND OF THE INVENTION

An important performance component of a golf club is its dynamic excitation response, i.e., the sensation or feel that the golf club delivers to the player at ball impact. Golf club heads typically include rigid metal striking faces, often associated with a harsh feel on off-center shots. To diminish unwanted vibration, inserts of various materials may be used in the striking face of the golf club head. However, such inserts are often configured in the striking face of the golf club head such that there is increased likelihood that an off-center hit results in a point of contact between a ball and the striking face of the golf club that is not positioned on the insert, effecting reduced shot accuracy and an unfavorable vibratory response, or feel. Further, such a configuration diminishes a golfer's confidence, which affects the performance of the golf club.

SUMMARY

Certain embodiments of the present invention, in one or more aspects thereof, may advantageously comprise a golf club head that delivers improved response on mishit shots, enhanced tactile feedback, and increased player confidence.

In various embodiments, a golf club head has a main body including a top portion, a bottom portion opposite the top portion, a striking face, and a rear portion opposite the striking face. The striking face has a striking face plane generally coplanar with the striking face and a striking face outer periphery that is coplanar with the striking face plane. The striking face outer periphery has an outer periphery heel portion, an outer periphery toe portion opposite the outer periphery heel portion, an outer periphery top portion, and an outer periphery bottom portion opposite the outer periphery top portion. The striking face also has a recess extending rearward from the striking face plane, and the recess includes a recess periphery coplanar with the striking face plane. The striking face further has an insert disposed within the recess. The striking face additionally has a minimum periphery width separating the striking face outer periphery and the recess periphery. The periphery width is no greater than 1.25 mm.

In various embodiments, the golf club head is a putter-type golf club head that has a main body including a top portion, a bottom portion opposite the top portion, a striking face, and a rear portion opposite the striking face. The striking face has a striking face plane generally coplanar with the striking face and a striking face outer periphery coplanar with the striking face plane. The striking face also has a recess extending rearward from the striking face plane, the recess including a recess periphery coplanar with the striking face plane. The striking face additionally has an insert disposed within the recess. An imaginary plane that is perpendicular to the striking face plane passes through the recess such that the imaginary plane intersects the striking face outer periphery proximate the bottom portion of the main body at a first imaginary point and intersects the striking face outer periphery distal the bottom portion of the main body at a second imaginary point. The imaginary plane also intersects the recess periphery at a third imaginary point proximate the bottom portion of the main body and intersects the recess periphery at a fourth imaginary point distal the bottom portion of the main body. The first imaginary point is spaced from the second imaginary point by a distance D. The third imaginary point is spaced from the first imaginary point by a distance $d_1$ and the fourth imaginary point is spaced from the second imaginary point by a distance $d_2$. At least one of a first ratio, $d_1/D$, and a second ratio, $d_2/D$, is no greater than 0.050.

In various embodiments, the golf club head has a main body including a top portion, a bottom portion opposite the top portion, a striking face, and a rear portion opposite the striking face. The striking face has a striking face plane generally coplanar with the striking face and a striking face outer periphery coplanar with the striking face plane. The striking face also has an insert located within the recess. The insert has a front surface, a rear surface opposite the front surface, an intermediate surface between the front surface and the rear surface, and a maximum length, $L_{max}$. The front surface is coplanar with the striking face plane and has a geometric center. A first imaginary plane that is perpendicular to the striking face plane passes through the geometric center such that the first imaginary plane intersects the striking face outer periphery proximate the bottom portion of the main body at a first imaginary point and intersects the striking face outer periphery distal the bottom portion of the main body at a second imaginary point. The first imaginary plane also intersects the recess periphery at a third imaginary point proximate the bottom portion of the main body and intersects the recess periphery at a fourth imaginary point distal the bottom portion of the main body. A second imaginary plane is perpendicular to the striking face plane and spaced from the first imaginary plane by a distance between $0.10*L_{max}$ and $0.40*L_{max}$ such that the second imaginary vertical plane intersects the striking face outer periphery proximate the bottom portion of the main body at a fifth imaginary point and intersects the striking face outer periphery distal the bottom portion of the main body at a sixth imaginary point. The second imaginary vertical plane also intersects the recess periphery at a seventh imaginary point proximate the bottom portion of the main body and intersects the recess periphery at an eighth imaginary point distal the bottom portion of the main body. The first imaginary point and the third imaginary point are spaced by a distance, $D_1$. The second imaginary point and the fourth imaginary point are spaced by a distance, $D_2$. The fifth imaginary point and the seventh imaginary point are spaced by a distance $D_3$. The sixth imaginary point and the eighth imaginary point are spaced by a distance $D_4$. At least one of $D_1$, $D_2$, $D_3$, and $D_4$ is less than or equal to 1.5 mm, and at least one of a first absolute difference between $D_1$ and $D_3$ and a second absolute difference between $D_2$ and $D_4$ is greater than or equal to 2.0 mm.

These and other features and advantages of the golf club head according to the invention in its various aspects, as provided by one or more of the various examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present invention, in one or more aspects thereof, is illustrated by way of example and not by way of limitation, in the figures of the accompanying drawings, where:

FIG. 1(*b*) is a toe-side elevation view thereof;

FIG. 1(*c*) is a top plan view thereof;

FIG. 1(*d*) is a front elevation view thereof;

FIG. 1(*e*) is a toe-side cross-sectional view in an imaginary plane A-A' that extends through a geometric center of a front face of an insert of the golf club head of FIG. 1(*d*);

FIG. 1(*f*) is a toe-side cross-sectional view in another imaginary plane B-B' that extends through the face of the golf club head of FIG. 1(*d*) further illustrating certain embodiments;

FIG. 1(*g*) is a front elevation view thereof further illustrating certain embodiments;

FIG. 2(*a*) is a top plan view of the golf club of FIG. 2;

FIG. 2(*b*) is a toe-side cross-sectional view in an imaginary plane C-C' of FIG. 2;

FIG. 3(*a*) is a toe-side cross-sectional view in an imaginary plane A-A' of FIG. 3;

FIG. 3(*b*) is a bottom side cross-sectional view in an imaginary plane B-B' of FIG. 3;

FIG. 4(*a*) is a toe-side cross-sectional view in an imaginary plane A-A' of FIG. 4;

FIG. 4(*b*) is a toe-side side cross-sectional view in an imaginary plane B-B' of FIG. 4;

FIG. 4(*c*) is a bottom-side cross-sectional view in an imaginary plane C-C' of FIG. 4;

FIG. 4(*d*) is a bottom-side cross-sectional view in an imaginary plane D-D' of FIG. 4;

FIG. 5(*a*) is a toe-side cross-sectional view in an imaginary plane A-A' of FIG. 5; and FIG. 5(*b*) is a toe-side cross-section view in an imaginary plane B-B' of FIG. 5.

For purposes of illustration, these figures are not necessarily drawn to scale. In all the figures, same or similar elements are designated by the same reference numerals.

DETAILED DESCRIPTION

Figure 1A:
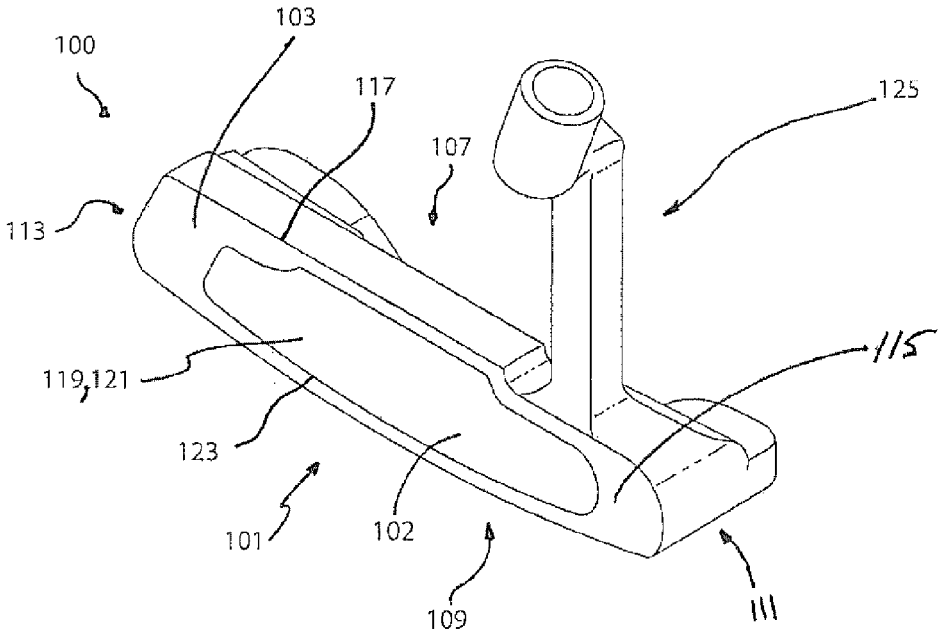
FIG. 1(*a*) is a heel-side perspective view of a golf club head according to various embodiments.
Figure 1B:
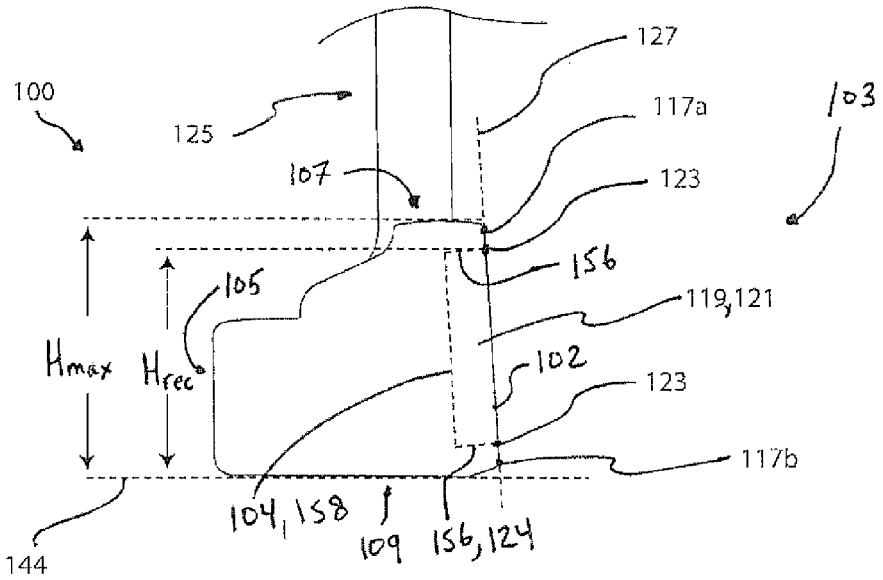
Figure 1C:
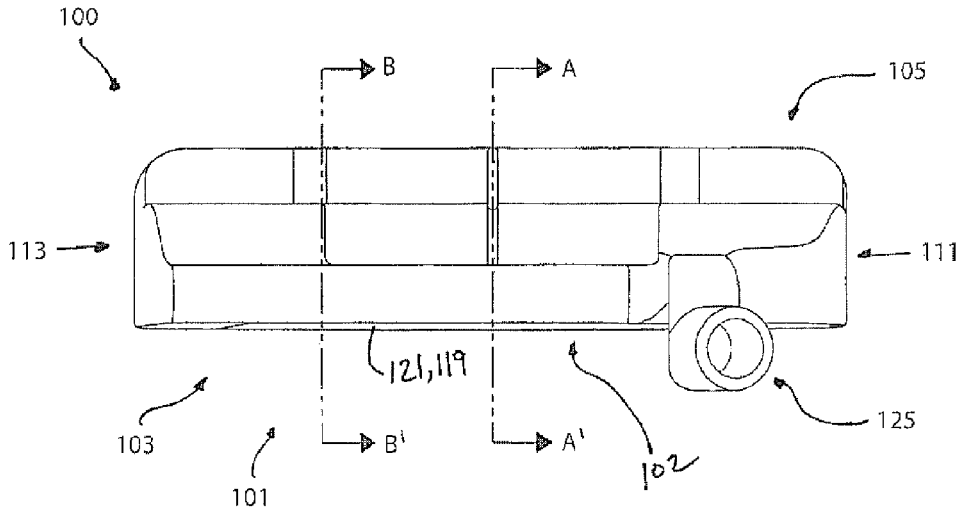
Figure 1D:
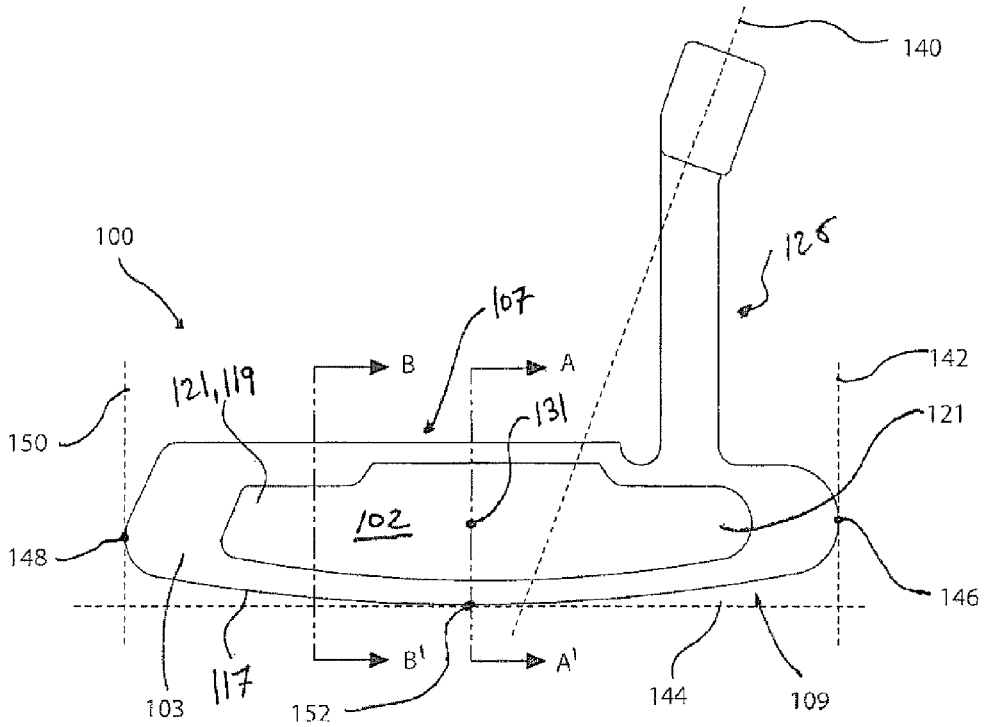
Figure 1E:
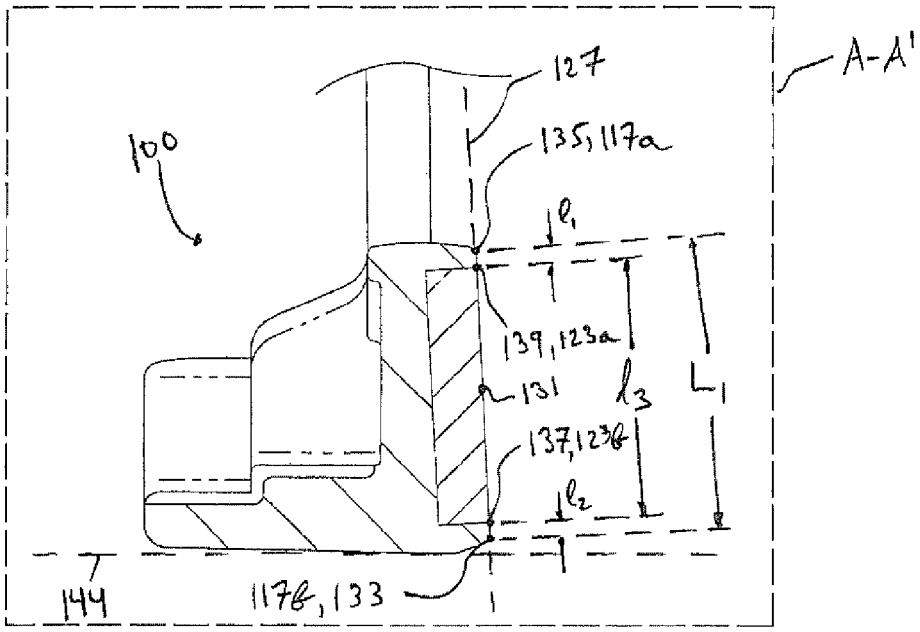
Figure 1F:
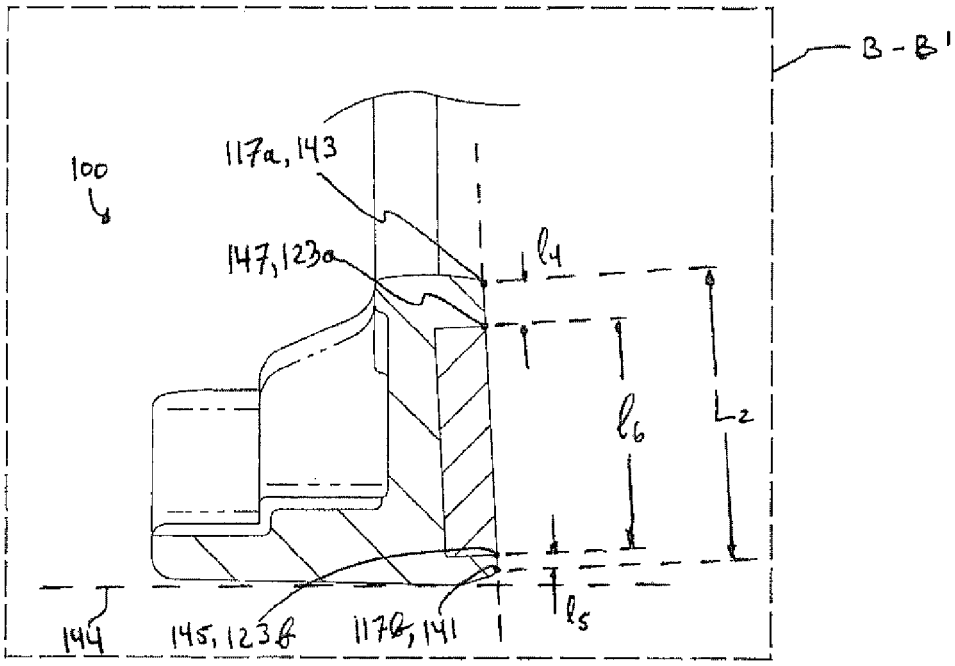
Figure 1G:
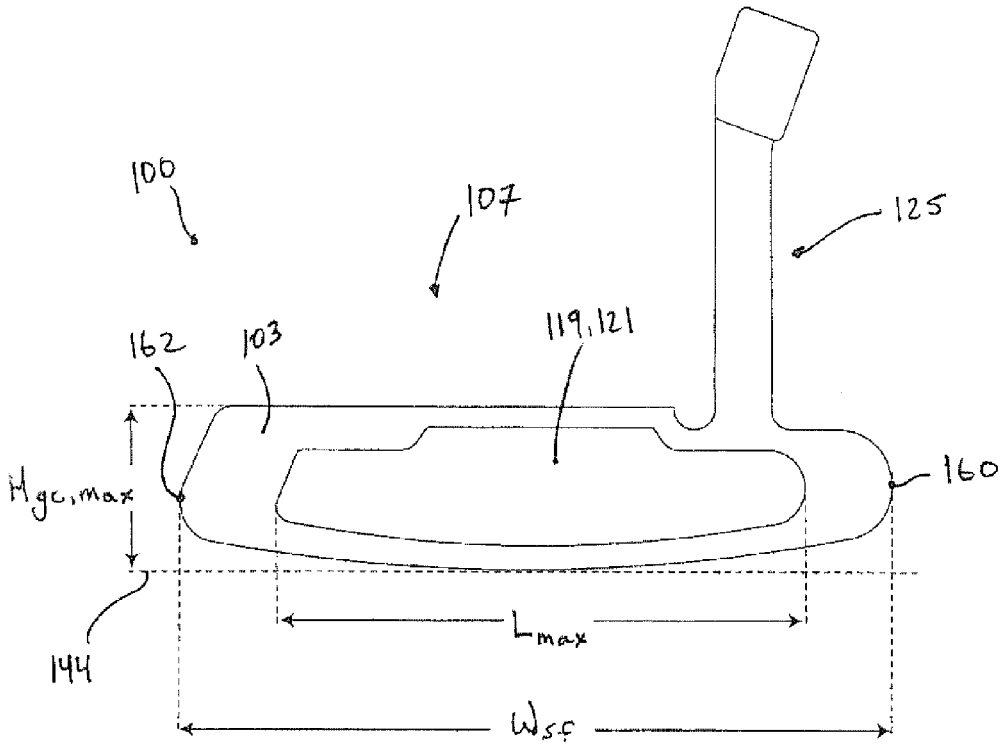

Representative examples of one or more novel and nonobvious aspects and features of the golf club head according to the present invention, disclosed below, are not intended to be limiting in any manner. Furthermore, the various aspects and features of the present invention may be used alone or in a variety of novel and nonobvious combinations and subcombinations with one another.

An important performance component of a golf club is its dynamic excitation response, i.e., the sensation or feel that the golf club delivers to the player at ball impact. To diminish unwanted vibration, inserts of various materials may be used in the striking face of the golf club head. Certain embodiments may advantageously comprise a golf club head that delivers improved forgiveness on mishit shots, enhanced tactile feedback, and increased player confidence by increasing the probability that a golf ball will contact the face of the golf club at a position location on the insert and by configuring such an insert to be perceived as having a large front surface area as contrasted with the remaining area of the striking face.

In one or more embodiments, and as depicted by way of example in FIGS. 1(*a*) through 1(*g*), a golf club head 100 comprises a putter-type golf club head. As shown, the club head 100 comprises an ANSER® style blade-type putter head. In other embodiments, the club head 100 comprises any of a mallet-style putter club head, blade-type putter club head, or the like.

Referring to FIG. 1(*a*) the golf club head 100 has a front portion 101, including a striking face 103 for striking a golf ball; a rear surface 105 opposite the front portion 101; a top portion 107; a bottom portion 109, which is opposite the top portion 107; a heel portion 111; and a toe portion 113, opposite the heel portion 111. The striking face 103 includes a striking face periphery portion 115; a striking face outer periphery 117; a recess 119; and a recess outer periphery 123. A hosel 125 extends from the top portion 107 proximate the heel portion 111 for receiving a shaft (not shown). While the figures of this application illustrate a golf club head 100 having a hosel 125, the golf club head 100 may simply have a shaft reception location, e.g. an aperture, in lieu of the illustrated hosel 125 and be "hosel-less." The hosel 125 may also generally take any shape, angle, or position with respect to the golf club head 100.

In one or more embodiments, as shown for example in FIG. 1(*b*), the striking face 103 is generally coplanar with an imaginary striking face plane 127. For example, the striking face 103 may be planar, be textured, include scorelines or grooves, have a peripheral groove encircling the recess 119, or have a slight curvature, e.g. a bulge and/or roll radius of no less than about 100 mm. The outermost boundary of the striking face 103, i.e. the outermost boundary of the portion of the club head 100 that is co-planar with the striking face plane 127, forms the striking face outer periphery 117. The recess 119 extends rearward from the striking face plane 127. The intersection of the outer boundary of the recess 119 and the striking face plane 127 forms the recess outer periphery 123. The area of the striking face 103 located between the recess outer periphery 123 and the striking face outer periphery 117 constitutes the striking face periphery portion 115.

Referring again to FIGS. 1(*a*) and 1(*b*), in one or more embodiments, an insert 121 is at least partially located within the recess 119. In some embodiments, the insert 121 is entirely located within the recess 119, for example as in the embodiment shown in FIG. 1(*a*). The insert 121 has a front surface 102, a rear surface 104, and an intermediate surface 156 located between the front surface 102 and the rear surface 104. The front surface 102 of the insert 121 is generally coplanar with the periphery portion 115 of the striking face 103. For example, in some embodiments, the front surface 102 of the insert 121 may have texturing, scorelines, grooves, and/or a peripheral groove proximate the outer boundary of the front surface 102 of the insert 121. In alternative embodiments, the insert 121 is configured such that the front surface 102 is recessed from the striking face plane 127. In further alternative embodiments, the insert 121 is configured such that the front surface 102 is raised relative to the periphery portion 115.

The insert 121 may be any of stainless steel, titanium, aluminum, copper, other metal, polymer, a fiber reinforced polymer, polyurethane, elastomeric material, nylon, wood, or any combination thereof. The insert 121 may be made up of single piece that is of a single material, or any combination of materials. Alternatively, the insert 121 may be made up of a series of integrated parts or portions that are each of the same, different, or any combination of materials. For example, a first portion of the insert 121 may be a metallic material, and a second portion of the insert 121 may be a polymeric material. The first portion of the insert 121 may also have an insert recess within which the second portion of the insert 121 is partially, or entirely, disposed. Configuring the insert 121 to include plural discrete portions each having different materials is advantageous, for example, in that it enables a variable response based on the location of impact between the golf club head 100 and a golf ball. It is noted that an insert including plural integrated, discrete parts may comprise any number of portions, and take any form or arrangement.

Referring to FIG. 1(*b*), the golf club head 100 is oriented in a reference position relative to a ground plane 144. The recess 119 has a bottom surface 158 and a side surface 124 intermediate the recess outer periphery 123 and the bottom surface 158. The side surface 124 is generally perpendicular to the striking face plane 127. Alternatively, the side surface 124 may extend toward the rear surface 104 by any angle, curve, series of steps, or any combination thereof from the striking face plane 127 to the bottom surface 158. In some embodiments, the side surface 124 continuously transitions into the bottom surface 158.

Referring again to FIG. 1(*b*), in one or more embodiments, the striking face outer periphery 117 has a striking face outer periphery top portion 117*a* and a striking face outer periphery bottom portion 117*b*. The recess outer periphery 123 also includes a recess outer periphery top portion 123*a* and a recess outer periphery bottom portion 123*b*. In some embodiments, the recess 119 may comprise a through-bore extending to the rear surface 105 of the golf club head 100. As such, the insert 121, when disposed in the recess 119 may be held in a position such that at least a portion of the rear surface 104 of the insert 121 is exposed The insert 121, as illustrated, is configured such that a central portion of the insert 121 is wider than either of a heelward portion and a toeward portion of the insert 121. It is noted, however, that in one or more alternative embodiments, the width of the insert 121 may be wider at either of the heelward or toeward portions than at the central portion. Such variation in width would have an effect on the feel of the golf club head 100, the vibratory response of the golf club head 100, and may ultimately increase player confidence. Because the insert 121 may have varying widths, the recess 119 would, therefore, also have varying elevations in a complementary manner. The insert 121, in this case, may or may not entirely contact the recess 119 depending on the particular geometries of the insert 121 and the recess 119, as well as the desired effect of such an arrangement of features. For example, the insert 121 may be configured such that a hollow portion is formed between the insert 121 and the bottom surface 158 of the recess 119 rearward of the insert 121.

Referring to FIG. 1(*d*), the front surface 102 of the insert 121 includes a geometric center 131. In one or more embodiments, the recess 119 and insert 121 may be symmetric about an axis of symmetry. In some embodiments, the axis of symmetry lies in the striking face plane 127 (see e.g. FIG. 1(*e*)) and passes through the geometric center 131 of the front surface 102 of the insert 121. In some such embodiments, the axis of symmetry further lies in a vertical plane when the golf club head is oriented in a reference position, as defined below. However, the recess 119 and/or the insert 121 may not be symmetric. For example, in some embodiments, the recess 119 and/or insert 121 generally follow the outer periphery 117 of the striking face 103.

Referring to FIGS. 1-1(*f*), as discussed above, the golf club head 100 is shown in a reference position relative to a ground plane 144. Referring specifically to FIG. 1(*d*), the hosel 125 includes a hosel axis 140. A first imaginary vertical plane 142 is perpendicular to the ground plane 144, perpendicular to the striking face plane 127, and passes through a heelwardmost point 146 of the striking face 103 of the club head 100. A second imaginary vertical plane 150 is parallel to the first imaginary plane 142 and passes through a toewardmost point 148 of the striking face 103 of the club head 100. "Reference position," as used herein, denotes a position of a golf club head, e.g. club head 100, wherein the hosel axis 140 lies in a vertical plane relative to the ground plane 144, and a point of intersection 152 between the bottom portion 109 of the club head 100 and the ground plane 144 is equally spaced between the first and the second imaginary planes 142 and 150.

Referring again to FIG. 1(*b*), a dimension $H_{max}$ represents a maximum height of the golf club head 100 from the ground plane 144 to a point of the top portion 107, excluding the hosel 125, measured in a direction perpendicular to the ground plane 144 when the club head 100 is in the reference position. In one embodiment, $H_{max}$ is greater than 15 mm. In another embodiment, $H_{max}$ is greater than 20 mm; and in yet another embodiment greater than 25 mm.

A dimension $H_{rec}$ represents a maximum height of the recess outer periphery top portion 123*a* from the ground plane 129 measured in a direction perpendicular to the ground plane 129. In one or more embodiments, $H_{rec}$ is such that the absolute difference between $H_{max}$ and $H_{rec}$ is no greater than 3 mm, more preferably no greater than 2 mm, and even more preferably no greater than 1.25 mm. These ranges enable a benefit of providing a club head whereby an insert portion is perceived to be large in comparison to the total striking face area, increasing performance.

FIG. 1(*c*) illustrates a top plan view of the golf club head 100 having a striking face 103, a recess 119, a hosel 125, and an insert 121 at least partially located within the recess 119. The golf club head 100 also has a front portion 101, a rear surface 105, a heel portion 111, and a toe portion 113. Also illustrated are cross-sections A-A' and B-B', discussed in more detail below. Cross-sections A-A' and B-B' are each perpendicular to the striking face 103 and each pass through a portion of the recess 119. Specifically, vertical cross-section A-A', as discussed below with respect to FIG. 1(*e*), passes through a portion of the golf club head 100 at the geometric center 131 (see e.g. FIG. 1(*d*)). Vertical cross section B-B', discussed below with respect to FIG. 1(*f*) passes through a portion of the golf club head 100 at a location other than the geometric center 131.

FIG. 1(*e*) is a cross-sectional view of the golf club head 100 from the perspective of vertical cross-section A-A' that passes through the geometric center 131 as illustrated in FIG. 1(*d*). The vertical cross-section A-A' intersects the golf club head 100 such that four points are created along the striking face plane 127: a point 133, a point 135, a point 137 and a point 139. The point 133 represents the point at which the striking face plane 127, the vertical cross-section A-A' and the striking face outer periphery bottom portion 117*b* meet. The point 135 represents the point at which the striking face plane 127, the vertical cross-section A-A' and the striking face outer periphery top portion 117*a* meet. The point 137 represents the point at which the striking face plane 127, the vertical cross-section A-A' and the recess outer periphery bottom portion 123*b* meet. The point 139 represents the point at which the striking face plane 127, the vertical cross-section A-A' and the recess outer periphery top portion 123*a* meet. A dimension $L_1$ represents a distance between the point 133 and the point 135. In this case, the distance between the point 133 and the point 135 corresponds to the overall width of the striking face 103 at the geometric center 131. A dimension $l_1$ represents the distance between the point 135 and the point 139. A dimension $l_2$ represents the distance between the point 133 and the point 137.

In one or more embodiments, the dimension $l_1$ is no greater than 1.25 mm, no greater than 1.10 mm, or no greater than 1.00 mm. Alternatively, or in addition to the dimension $l_1$ being within these ranges, the distance $l_2$ may be no greater than 1.25 mm, no greater than 1.10 mm, or no greater than 1.00 mm, in various embodiments. Alternatively, or in addition to the dimensions $l_1$ and $l_2$ individually, or in combination, being within these range, the distance between similar points in the heel portion and toe portion of the striking face periphery portion 117 and heel portion and toe portion of the recess periphery portion 123, which are discussed below, and best illustrated in FIG. 3(*b*) may be no greater than 1.25 mm, no greater than 1.10 mm, or greater than 1.00 mm.

In one or more embodiments, at least one of the ratios $l_1/L_1$ and $l_2/L_1$ is no greater than 0.050, no greater than 0.045, or no greater than 0.040. A dimension $l_3$ represents the distance between the point 137 and the point 139. In some embodiments, a ratio $l_3/L_1$ is no less than 0.90, no less than 0.95, or no less than 0.99.

FIG. 1(*f*) is a cross-sectional view of the golf club head 100 from the perspective of vertical cross-section B-B' that passes through a portion of the golf club head 100 at a location other than the geometric center 131 as illustrated in FIG. 1(*d*). The vertical cross-section B-B' intersects the golf club head 100 such that four points are created along the striking face plane 127: a point 141, a point 143, a point 145 and a point 147. The point 141 represents the point at which the striking face plane 127, the vertical cross-section B-B' and the striking face outer periphery bottom portion 117*b* meet. The point 143 represents the point at which the striking face plane 127, the vertical cross-section B-B' and the striking face outer periphery top portion 117*a* meet. The point 145 represents the point at which the striking face plane 127, the vertical cross-section B-B' and the recess outer periphery bottom portion 123*b* meet. The point 147 represents the juncture at which the striking face plane 127, the vertical cross-section B-B' and the recess outer periphery top portion 123*a* meet. A dimension $L_2$ represents a distance between the point 141 and the point 143. The distance $l_3$ between the point 141 and the point 143 corresponds to the overall width of the striking face 103 at the location of the vertical cross-section B-B'. A dimension $l_4$ represents the distance between the point 143 and the point 147. The dimension $l_4$ as illustrated in FIG. 1(*f*) is greater than dimension $l_1$ as illustrated in FIG. 1(*e*), but $l_4$ may be greater than or equal to dimension $l_1$ depending on the geometry of the golf club head 100. The distance between point 141 and the point 145, is represented by the dimension $l_5$. The distance between the point 145 and the point 147 is represented by dimension $l_6$. The dimension $l_6$ is illustrated as being less than the dimension $l_3$ illustrated in FIG. 1(*e*), but this relationship may be reciprocated depending on the particular geometry of the golf club head 100.

FIG. 1(*g*) illustrates a front elevation view of the golf club head 100, in the reference position relative to the ground plane 144 having a recess 119, an insert 121 inside the recess 119, a hosel 125, a heelward-most point of the striking face 149 and a toeward-most point of the striking face 151. A maximum length, $L_{max}$ represents the overall length of the insert 121 measured in the horizontal direction, a dimension $W_{sf}$ represents an overall width of the striking face 103 (i.e. the extent of the striking face outer periphery 117), measured in the horizontal direction, and a dimension $H_{gc\ max}$ represents a maximum height of the top portion 107 of the golf club head 100 relative to the ground plane 144. $W_{sf}$ is measured between the toeward-most point of the striking face 151 and the heelward-most point of the striking face 149.

Referring to FIGS. 1(*d*)-1(*f*), in one embodiment, when vertical cross-section A-A' is taken at the geometric center 131, and vertical cross-section B-B' is parallel to the vertical cross-section A-A' and spaced from the vertical cross-section A-A' by a distance between $0.10*L_{max}$ and $0.40*L_{max}$, at least one of the dimensions $l_2$, $l_1$, $l_5$, and $l_4$ are less than or equal to 1.5 mm. According to an embodiment, at least one of an absolute value of the difference between $l_2$ and $l_5$, and an absolute value of the difference between $l_1$ and $l_4$ is greater than or equal to 2.0 mm. However, the values of the aforementioned absolute values may be less than or equal to 2.0 mm, depending on the particular geometry of the golf club head 100.

Figure 2:
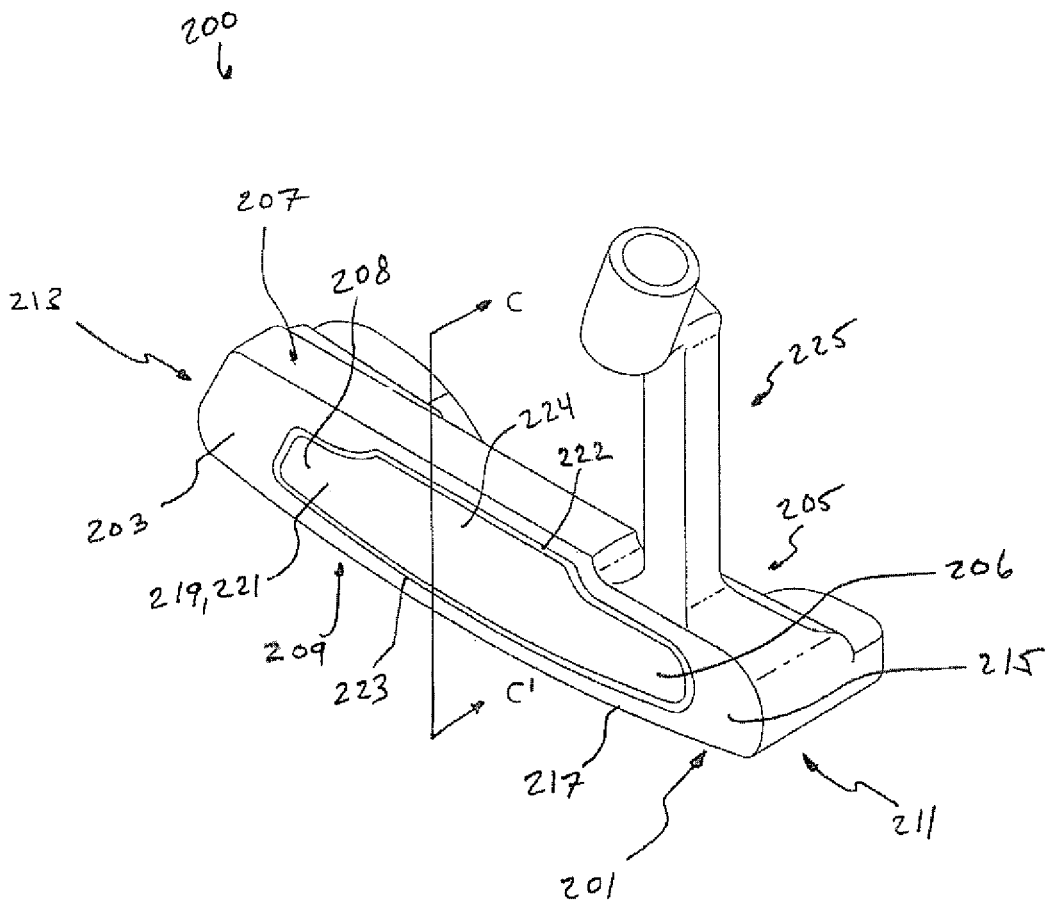
FIG. 2 is a heel-side perspective view of a golf club head according to various embodiments.
Figure 2:
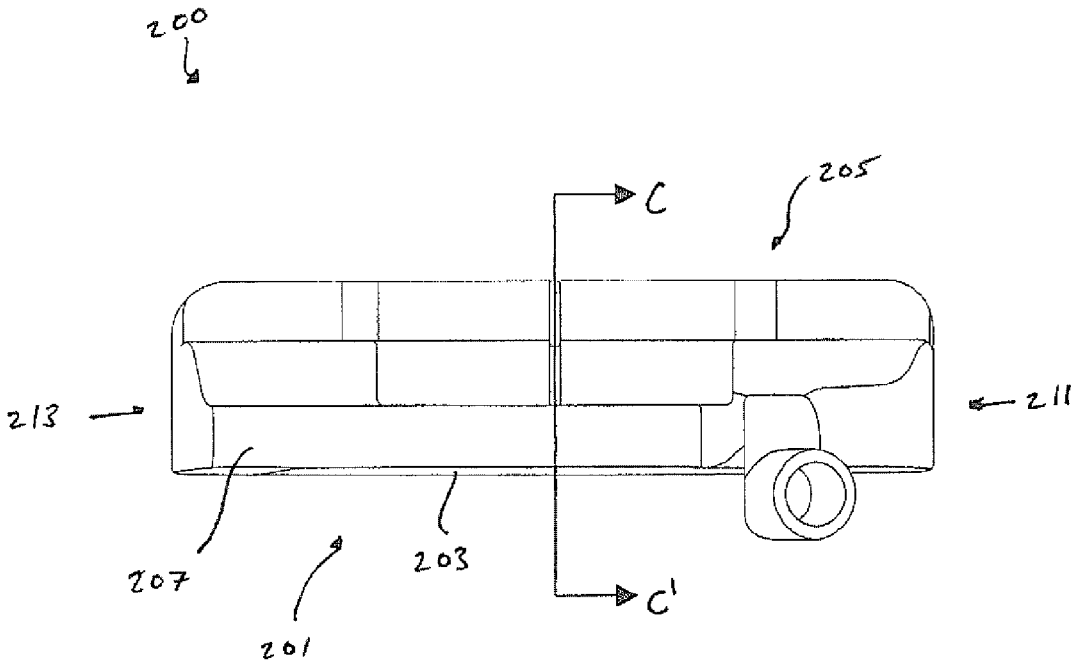
Figure 2:
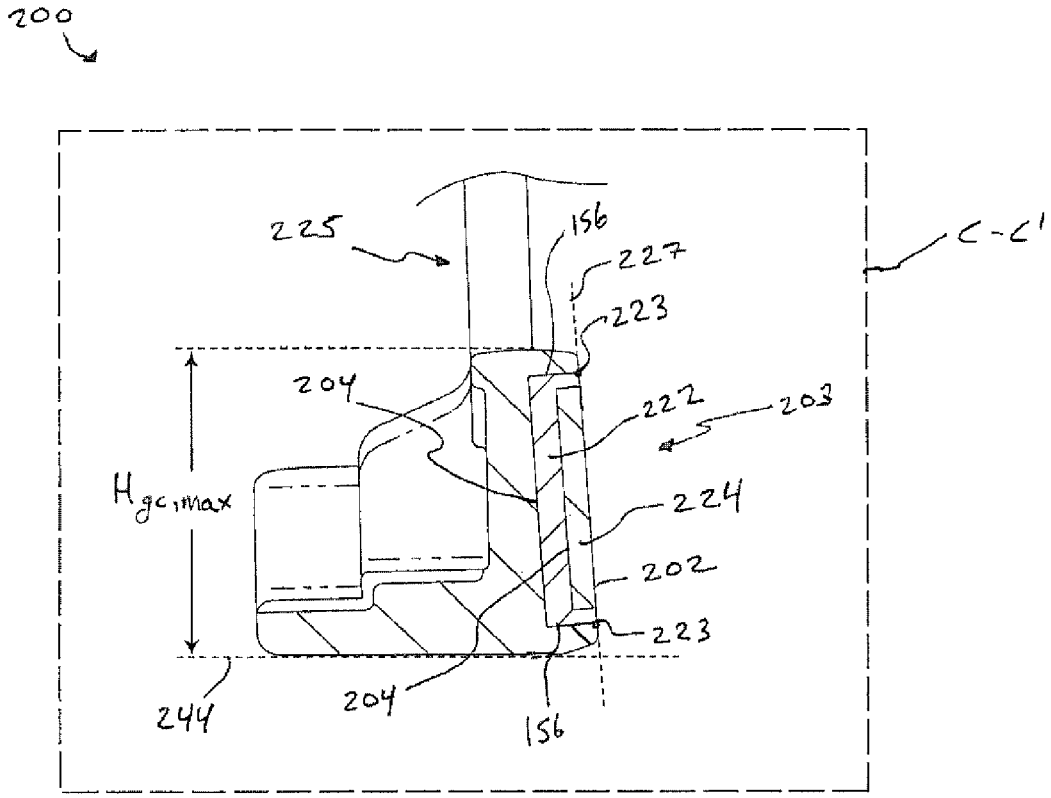

In one or more embodiments, and as depicted by way of example in FIG. 2 to FIG. 2(*b*), a golf club head 200 is a head for a putter-type golf club. Referring to FIGS. 2-2(*b*), the golf club head 200 is shown in the reference position and has a front portion 201, including a striking face 203 for striking a golf ball; a rear portion 205; a top portion 207; a bottom portion 209, which is opposite the top portion 207; a heel portion 211; a toe portion 213, opposite the heel portion 211; a striking face periphery portion 215; a striking face outer periphery 217; a recess 219; an insert 221 disposed within the recess 219, and having a first insert portion 222 and a second insert portion 224; a recess outer periphery 223; and a hosel 225 proximate the heel portion 211 of the striking face 203 for receiving a shaft (not shown). While the figures of this application illustrate a golf club head 200 having a hosel 225, the golf club head may simply have a shaft reception location in lieu of the illustrated hosel 225 and be "hosel-less." The hosel 225 may also take any shape, angle, or position with respect to the golf club head 225. For example, in alternative embodiments, the hosel 225 is located in a central location, e.g. in a "center-shafted" golf club, and in other embodiments, the hosel 225 may be located proximate the toe portion 213 of the golf club head, e.g. in a "heel-shafted" golf club. The striking face periphery portion 215 surrounds at least a portion of the recess 219. Unless otherwise described, these features are defined and interrelated in similar manner to the like features of the embodiments of the present invention discussed with regard to FIGS. 1(*a*)-1(*g*).

Referring e.g. to FIG. 2(*b*), the insert 221 has a front surface 202, a rear surface 204, an intermediate surface 256, a heel portion 206, and a toe portion 208. The front surface 202 of the insert 221 is coplanar with the striking face 203. The insert 221 may be any of stainless steel, titanium, aluminum, copper, other metal, polymer, a fiber reinforced polymer, or any combination thereof. The insert first portion 222 may be a metallic material, and the insert second portion 224 may be a polymeric material. The insert first portion 222 may also have an insert recess such that the insert second portion 224 is disposed within the insert recess of the first portion 222 of the insert 121. However, it is noted that an insert 121 that is made up of a series of integrated parts may take any form or arrangement.

Vertical cross-section C-C' is perpendicular to a striking face plane 227 (shown in FIGS. 2 and 2(*a*)). Vertical cross-section C-C', discussed below with respect to FIG. 2(*a*), passes through a portion of the golf club head 200. In some embodiments, the vertical cross-section passes through a geometric center of the front surface 202 of the insert 221.

FIG. 2(*b*) illustrates a toe-side cross-sectional view of the golf club head 200 from the perspective of vertical cross-section C-C' that passes through the golf club head 200 as illustrated in FIGS. 2 and 2(*a*). As shown, the striking face plane 227 is generally coplanar with the striking face 203 of the golf club head 200.

As previously described with regard to the embodiments shown in FIGS. 1(*a*)-1(*g*), a dimension $H_{gc\ max}$ represents a maximum height of the golf club head 200 from the ground plane 244 to the top portion 207 measured in a direction perpendicular to the ground plane 244.

Figure 3:
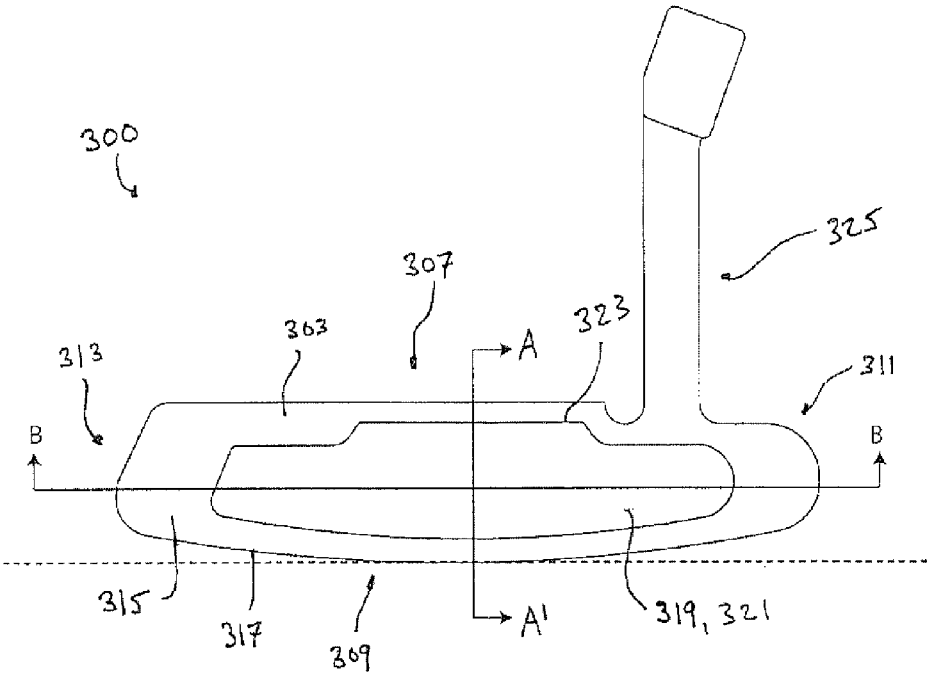
FIG. 3 is a front elevation view of a golf club according to various embodiments.
Figure 3:
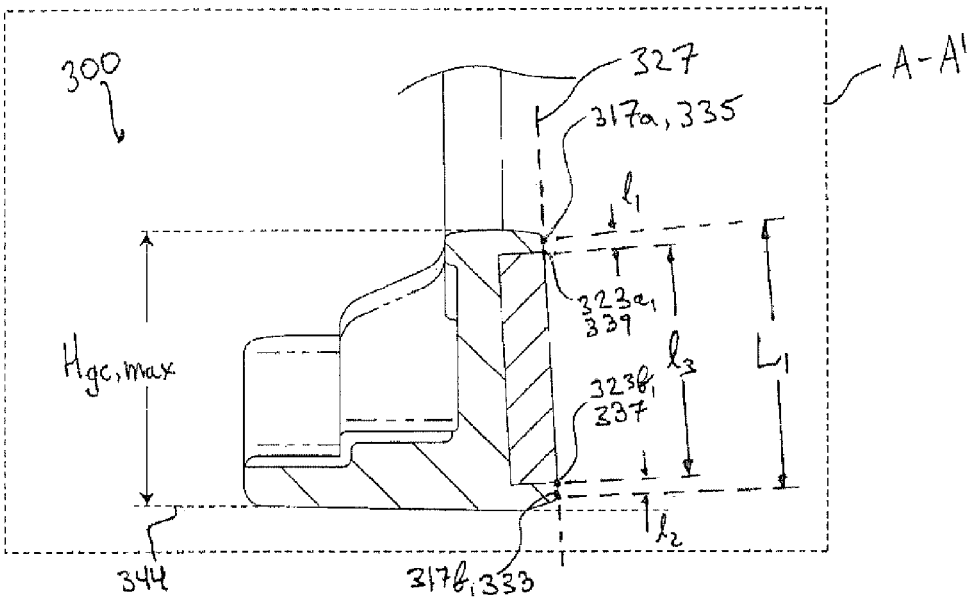
Figure 3:
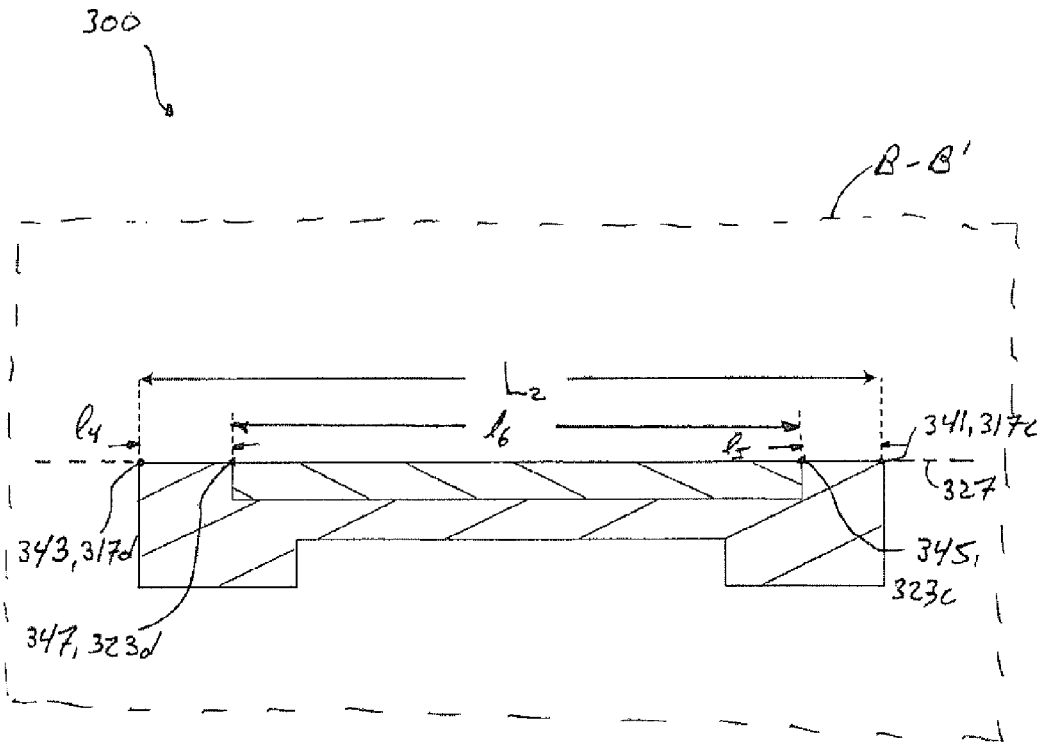

In one or more embodiments, and as depicted by way of example in FIG. 3 to FIG. 3(*d*), a golf club head 300 is a head for a putter-type golf club. Referring to FIG. 3 the golf club head 300 is oriented in the reference position and has a front portion 301, including a striking face 303 for striking a golf ball; a top portion 307; a bottom portion 309, which is opposite the top portion 307; a heel portion 311; a toe portion 313, opposite the heel portion 311; a striking face periphery portion 315; a striking face outer periphery 317; a recess 319; an insert 321 disposed within the recess 319; a recess outer periphery 323; and a hosel 325 at a heel side of the striking face 303 for receiving a shaft (not shown). While the figures of this application illustrate a golf club head 300 having a hosel 325, the golf club head may simply have a shaft reception location, e.g. an aperture, in lieu of the illustrated hosel 325 and be "hosel-less." The hosel 325 may also take any shape, angle, or position with respect to the golf club head 325. The striking face periphery portion 315 surrounds at least a portion of the recess 319. Unless otherwise described, these features are defined and interrelated in similar manner to the like features of the embodiments of the present invention discussed with regard to FIGS. 1(*a*)-1(*g*).

Vertical cross-section A-A' is perpendicular to a striking face plane 327 (shown in FIG. 3(*a*)). Vertical cross-section A-A', discussed below with respect to FIG. 3(*a*), passes through a portion of the golf club head 300. Horizontal cross-section B-B' is perpendicular to the striking face plane 327 and also perpendicular to cross-section A-A'. Horizontal cross-section B-B', discussed below with respect to FIG. 3(*a*), passes through a portion of the golf club head 300.

FIG. 3(*a*) is a cross-sectional view of the golf club head 300 from the perspective of vertical cross-section A-A' that passes through the golf club head 300 as illustrated in FIG. 3. The vertical cross-section A-A' intersects the golf club head 300 such that four points are created along the striking face plane 327: a point 333, a point 335, a point 337 and a point 339. The point 333 represents the point at which the striking face plane 327, the vertical cross-section A-A' and the striking face outer periphery bottom portion 317*b* meet. The point 335 represents the point at which the striking face plane 327, the vertical cross-section A-A' and the striking face outer periphery top portion 317*a* meet. The point 337 represents the point at which the striking face plane 327, the vertical cross-section A-A' and the recess outer periphery bottom portion 323*b* meet. The point 339 represents the point at which the striking face plane 327, the vertical cross-section A-A' and the recess outer periphery top portion 323*a* meet. A dimension $L_1$ represents a distance between the point 333 and the point 335. The distance $L_1$ between the point 333 and the point 335 corresponds to the overall width of the striking face 303 at the location of cross-section A-A'. A dimension $l_1$ represents the distance between the point 335 and the point 339. A dimension $l_2$ represents the distance between the point 333 and the point 337.

In one or more embodiments, the dimension $l_1$ is no greater than 1.25 mm, no greater than 1.10 mm, or no greater than 1.00 mm. Alternatively, or in addition to the dimension $l_1$ being within these ranges, $l_2$ may be no greater than 1.25 mm, no greater than 1.10 mm, or no greater than 1.00 mm. Alternatively, or in addition to the dimensions $l_1$ and $l_2$ individually, or in combination, being within these ranges, the distance between similar points in the heel portion and toe portion of the striking face periphery portion 317 and heel portion and toe portion of the recess periphery portion 323, which are discussed above, and best illustrated in FIG. 3 may be no greater than 1.25 mm, no greater than 1.10 mm, or no greater than 1.00 mm.

In one or more embodiments, at least one of the ratios $l_1/L_1$ and $l_2/L_1$ is no greater than 0.050, no greater than 0.045, or no greater than 0.040. A dimension $l_3$ represents the distance between the point 337 and the point 339. In some embodiments a ratio $l_3/L_1$ is no less than 0.90, no less than 0.95, or no less than 0.99.

As shown, a dimension $H_{gc\ max}$ represents a maximum height of the golf club head 300 from the ground plane 344 to a point of the top portion 307 measured in a direction perpendicular to the ground plane 329.

FIG. 3(*b*) is a cross-sectional view of the golf club head 300 from the perspective of horizontal cross-section B-B' that passes through a portion of the golf club head 300 as illustrated in FIG. 3. The horizontal cross-section B-B' intersects the golf club head 300 such that four points are created along the striking face plane 327: a point 341, a point 343, a point 345 and a point 347. The point 341 represents the point at which the striking face plane 327, the vertical cross-section B-B' and the striking face outer periphery heel portion 317*c* meet. The point 343 represents the point at which the striking face plane 327, the vertical cross-section B-B' and the striking face outer periphery toe portion 317*d* meet. The point 345 represents the point at which the striking face plane 327, the vertical cross-section B-B' and the recess outer periphery heel portion 323*c* meet. The point 347 represents the point at which the striking face plane 327, the vertical cross-section B-B' and the recess outer periphery toe portion 323*d* meet.

A dimension $L_2$ represents a distance between the point 341 and the point 343. The distance $L_2$ between the point 341 and the point 343 corresponds to the overall width of the striking face 303 at the location of the horizontal cross-section B-B'. A dimension $l_4$ represents the distance between the point 343 and the point 347. The distance between point 341 and the point 345, is represented by a dimension $l_5$. The dimension $l_4$ as illustrated is greater than dimension $l_5$ as illustrated, but $l_4$ may be greater than or equal to dimension $l_5$ depending on the geometry of the golf club head 100. The distance between the point 345 and the point 347 is represented by a dimension $l_6$. In certain embodiment a ratio $l_6/L_2$ is no less than 0.80, no less than 0.90, or no less than 0.99.

Figure 4:
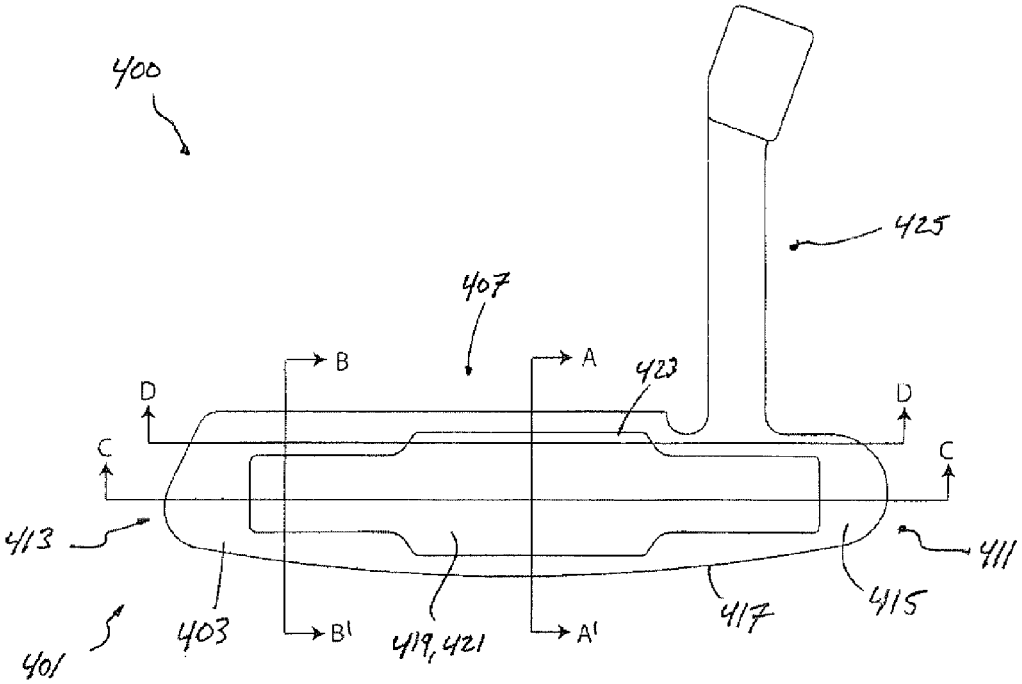
FIG. 4 is a front elevation view of a golf club according to various embodiments.
Figure 4:
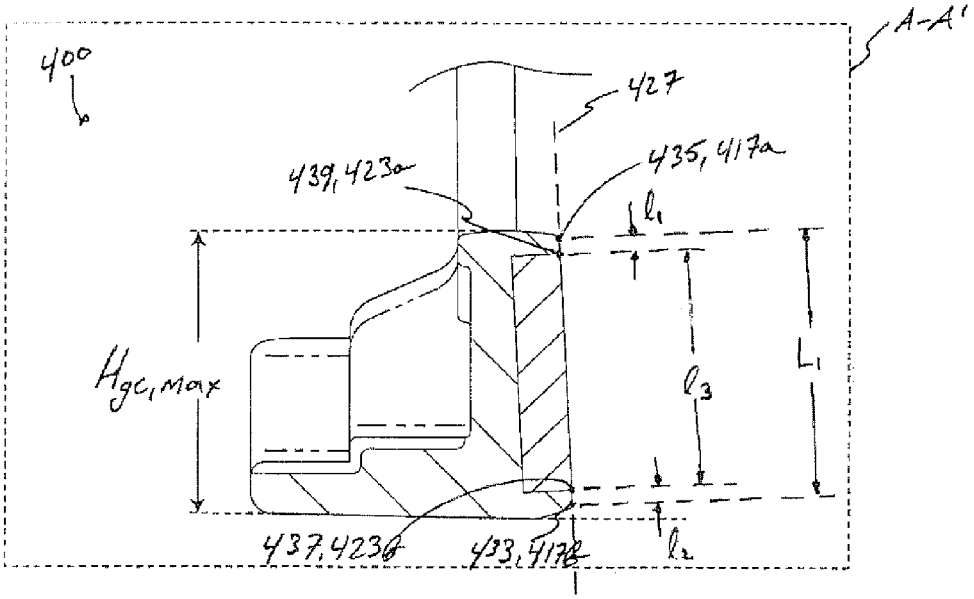
Figure 4:
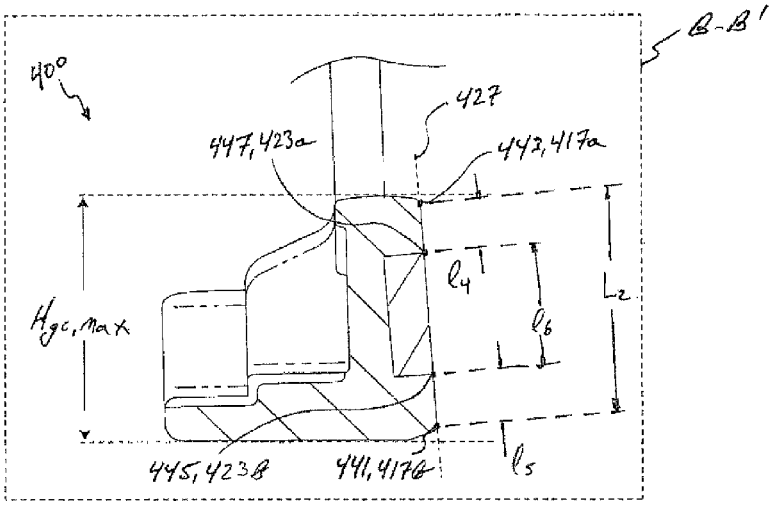
Figure 4:
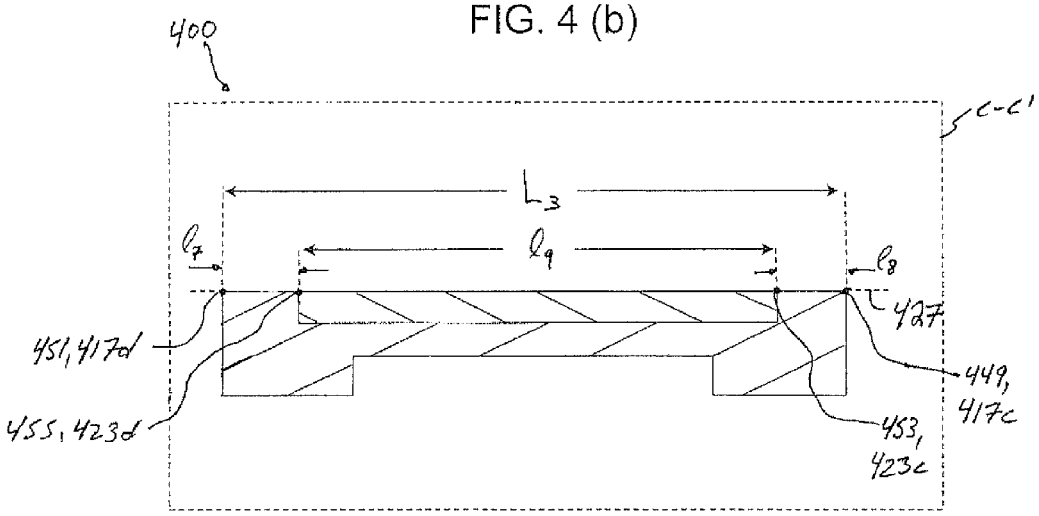
Figure 4:
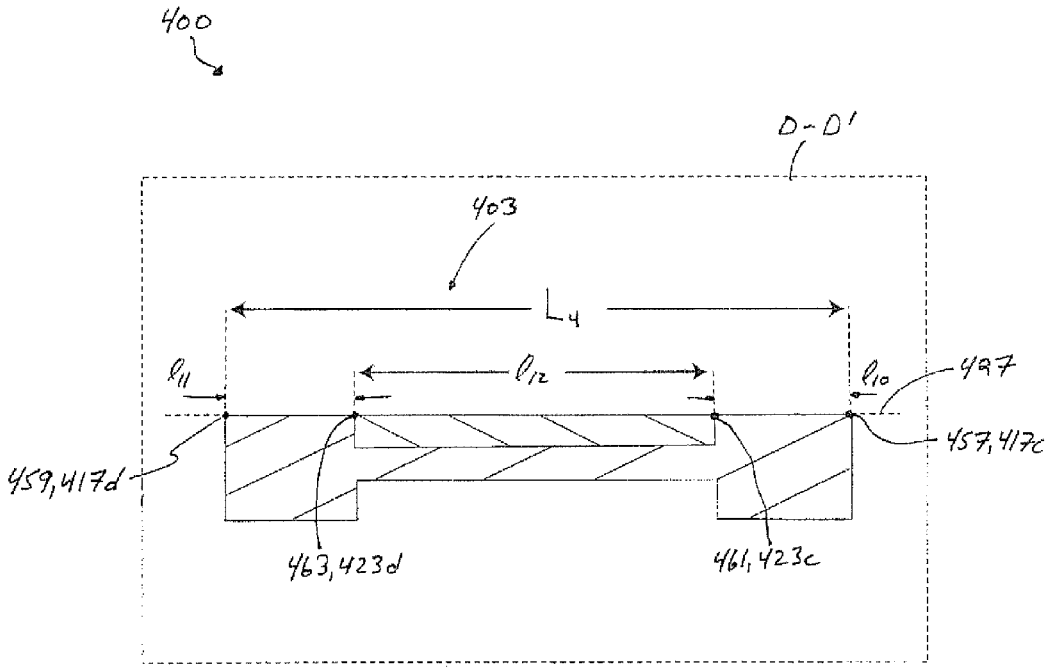

In one or more embodiments, and as depicted by way of example in FIG. 4 to FIG. 4(*d*), a golf club head 400 is a head for a putter-type golf club. Referring to FIG. 4, the golf club head 400 has a front portion 401, including a striking face 403 for striking a golf ball; a top portion 407; a bottom portion 409, which is opposite the top portion 407; a heel portion 411; a toe portion 413, opposite the heel portion 411; a striking face periphery portion 415; a striking face outer periphery 417; a recess 419; an insert 421 disposed within the recess 419; a recess outer periphery 423; and a hosel 425 at proximate the heel portion 411 of the striking face 403 for receiving a shaft (not shown). The striking face periphery portion 415 surrounds at least a portion of the recess 419. Unless otherwise described, these features are defined and interrelated in similar manner to the like features of the embodiments of the present invention discussed with regard to FIGS. 1(*a*)-1(*g*).

Vertical cross-section A-A' is perpendicular to a striking face plane 427 (shown in FIG. 4(*a*)). Vertical cross-section A-A', discussed below with respect to FIG. 4(*a*), passes through a portion of the golf club head 400. Vertical cross-section B-B' is parallel to vertical cross-section B-B' and perpendicular to the striking face plane 327. Vertical cross-section B-B', discussed below with respect to FIG. 4(*b*), passes through a portion of the golf club head 400 that is different than the position at which vertical cross-section A-A' passes through the golf club head 400. Horizontal cross-section C-C' is perpendicular to the striking face plane 427 and perpendicular to vertical cross-section A-A'. Horizontal cross-section C-C', discussed below with respect to FIG. 4(*c*), passes through a portion of the golf club head 400. Horizontal cross-section D-D' is perpendicular to the striking face plane 427 and perpendicular to vertical cross-section A-A'. Horizontal cross-section D-D', discussed below with respect to FIG. 4(*d*), passes through a portion of the golf club head 400 that is different than, and vertically spaced from, the position where horizontal cross-section C-C' passes through the golf club head 400.

FIG. 4(*a*) is a cross-sectional view of the golf club head 400 from the perspective of vertical cross-section A-A' that passes through the golf club head 400 as illustrated in FIG. 4. The vertical cross-section A-A' intersects the golf club head 400 such that four points are created along the striking face plane 427: a point 433, a point 435, a point 437 and a point 439. The point 433 represents the point at which the striking face plane 427, the vertical cross-section A-A' and the striking face outer periphery bottom portion 417*b* meet. The point 435 represents the point at which the striking face plane 427, the vertical cross-section A-A' and the striking face outer periphery top portion 417*a* meet. The point 437 represents the point at which the striking face plane 427, the vertical cross-section A-A' and the recess outer periphery bottom portion 423*b* meet. The point 439 represents the point at which the striking face plane 427, the vertical cross-section A-A' and the recess outer periphery top portion 423*a* meet. A dimension $L_1$ represents a distance between the point 433 and the point 435. The distance $L_1$ between the point 433 and the point 435 corresponds to the overall width of the striking face 403 at the position of vertical cross-section A-A'. A dimension $l_1$ represents the distance between the point 435 and the point 439.

In one or more embodiments, the dimension $l_1$ is no greater than 1.25 mm, no greater than 1.10 mm, or no greater than 1.00 mm. Alternatively, or in addition to the dimension $l_1$ being within these ranges, the distance between the point 433 and the point 437, which is represented by $l_2$ may be no greater than 1.25 mm, no greater than 1.10 mm, or no greater than 1.00 mm. Alternatively, or in addition to the dimensions $l_1$ and $l_2$ individually, or in combination, being within these ranges, the distance between similar points in the heel portion and toe portion of the striking face periphery portion 417 and heel portion and toe portion of the recess periphery portion 423, which are discussed below, and best illustrated in FIG. 4(*c*) may be no greater than 1.25 mm, no greater than 1.10 mm, or no greater than 1.00 mm.

In one or more embodiments, at least one of the ratios $l_1/L_1$ and $l_2/L_1$ is no greater than 0.050, no greater than 0.045, or no greater than 0.040. A dimension $l_3$ represents the distance between the point 437 and the point 439. In one embodiment, a ratio $l_3/L_1$ is no less than 0.90, no less than 0.95, or no less than 0.99.

FIG. 4(*b*) is a cross-sectional view of the golf club head 400 from the perspective of vertical cross-section B-B' that passes through a portion of the golf club head 400 at a location other than the location where vertical cross-section A-A' passes through the golf club head 400 as illustrated in FIG. 4. The vertical cross-section B-B' intersects the golf club head 400 such that four points are created along the striking face plane 427: a point 441, a point 443, a point 445 and a point 447. The point 441 represents the point at which the striking face plane 427, the vertical cross-section B-B' and the striking face outer periphery bottom portion 417*b* meet. The point 443 represents the point at which the striking face plane 427, the vertical cross-section B-B' and the striking face outer periphery top portion 417*a* meet. The point 445 represents the point at which the striking face plane 427, the vertical cross-section B-B' and the recess outer periphery bottom portion 423*b* meet. The point 447 represents the point at which the striking face plane 427, the vertical cross-section B-B' and the recess outer periphery top portion 423*a* meet. A dimension $L_2$ represents a distance between the point 441 and the point 443. The distance $L_2$ between the point 441 and the point 443 corresponds to the overall width of the striking face 403 at the location of the vertical cross-section B-B'. A dimension $l_4$ represents the distance between the point 443 and the point 447. In one embodiment, the dimension $l_4$ as illustrated in FIG. 1(*f*) is greater than dimension $l_1$ as illustrated in FIG. 1(*e*), but $l_4$ may be greater than or equal to dimension depending on the geometry of the golf club head 400. The distance between point 441 and the point 445, is represented by the dimension $l_5$. The distance between the point 445 and the point 447 is represented by dimension $l_6$.

In one or more embodiments, the dimension $l_6$ is less than the dimension $l_3$, but alternative embodiments may reciprocate this relationship. Further, in one or more embodiments, the insert 421 has multiple elevation changes across its length.

FIG. 4(*c*) is a cross-sectional view of the golf club head 400 from the perspective of horizontal cross-section C-C' that passes through a portion of the golf club head 400 as illustrated in FIG. 4. The horizontal cross-section C-C' intersects the golf club head 400 such that four points are created along the striking face plane 427: a point 449, a point 451, a point 453 and a point 455. The point 449 represents the point at which the striking face plane 427, the vertical cross-section C-C' and the striking face outer periphery heel portion 417*c* meet. The point 451 represents the point at which the striking face plane 427, the vertical cross-section C-C' and the striking face outer periphery toe portion 417*d* meet. The point 453 represents the point at which the striking face plane 427, the vertical cross-section C-C' and the recess outer periphery heel portion 423*c* meet. The point 455 represents the point at which the striking face plane 427, the vertical cross-section C-C' and the recess outer periphery toe portion 423*d* meet. A dimension $L_3$ represents a distance between the point 449 and the point 451. The distance $L_3$ between the point 449 and the point 451 corresponds to the overall width of the striking face 403 at the location of the horizontal cross-section C-C'. A dimension $l_7$ represents the distance between the point 451 and the point 455. The distance between point 449 and the point 453, is represented by the dimension $l_8$. The dimension $l_7$ as illustrated is greater than dimension $l_8$ as illustrated, but $l_7$ may be greater than or equal to dimension $l_8$ depending on the geometry of the golf club head 400. The distance between the point 453 and the point 455 is represented by dimension $l_9$. In certain embodiments, a ratio $l_9/L_3$ is no less than 0.80, no less than 0.90, or no less than 0.99.

FIG. 4(*d*) is a cross-sectional view of the golf club head 400 from the perspective of horizontal cross-section D-D' that passes through a portion of the golf club head 400 as illustrated in FIG. 4. The horizontal cross-section D-D' intersects the golf club head 400 such that four points are created along the striking face plane 427: a point 457, a point 459, a point 461 and a point 463. The point 457 represents the point at which the striking face plane 427, the vertical cross-section D-D' and the striking face outer periphery heel portion 417*c* meet. The point 459 represents the point at which the striking face plane 427, the vertical cross-section D-D' and the striking face outer periphery toe portion 417*d* meet. The point 461 represents the point at which the striking face plane 427, the vertical cross-section D-D' and the recess outer periphery heel portion 423*c* meet. The point 463 represents the point at which the striking face plane 427, the vertical cross-section D-D' and the recess outer periphery toe portion 423*d* meet. A dimension $L_4$ represents a distance between the point 459 and the point 457. The distance $L_4$ between the point 459 and the point 457 corresponds to the overall width of the striking face 403 at the location of the horizontal cross-section D-D'. A dimension $l_{10}$ represents the distance between the point 457 and the point 461. The distance between point 459 and the point 463, is represented by the dimension $l_{11}$. In one embodiment, the dimension $l_{10}$ as illustrated is greater than dimension $l_{11}$ as illustrated, but $l_{11}$ may be greater than or equal to dimension $l_{10}$ depending on the geometry of the golf club head 400. The distance between the point 461 and the point 463 is represented by dimension $l_{12}$.

In one or more embodiments, the dimension $l_{12}$ is less than the dimension $l_9$, but alternative embodiments may reciprocate this relationship. Further, in one or more aspects, the insert 421 has multiple elevation changes.

Figure 5:
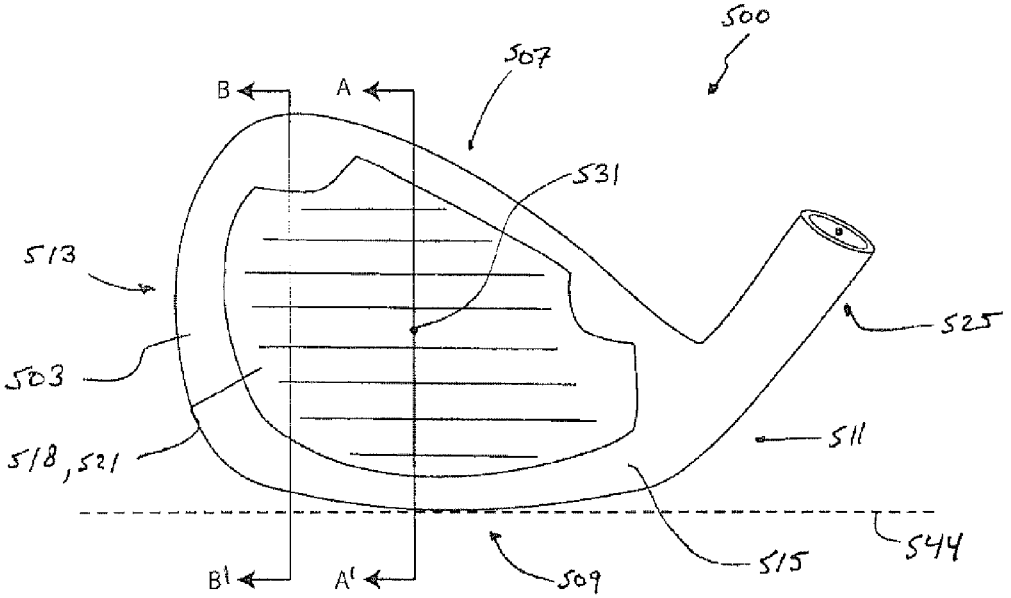
FIG. 5 is a front elevation view of a golf club according to various embodiments.
Figure 5A:
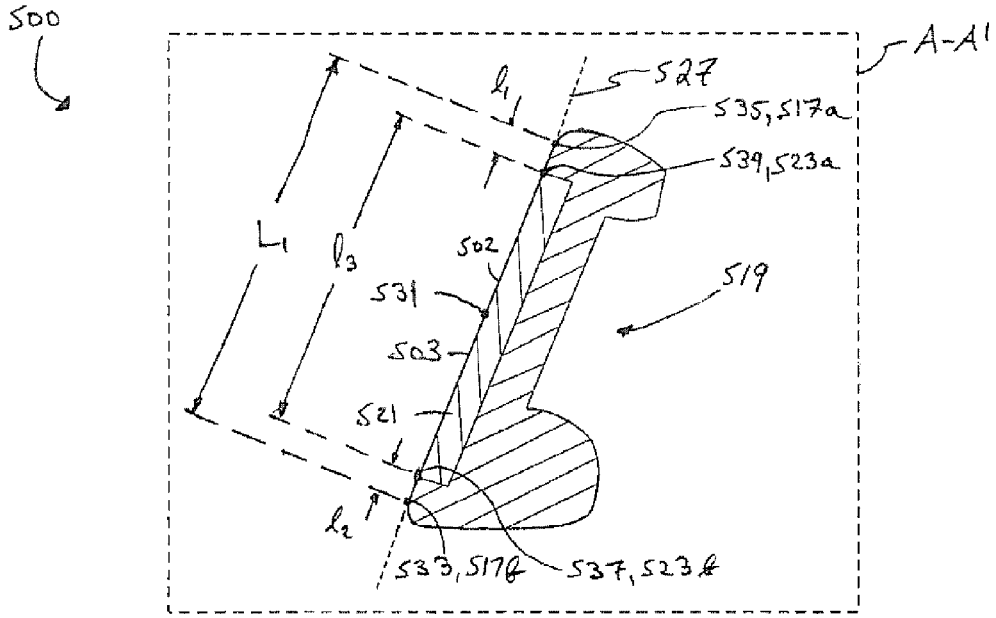
Figure 5B:
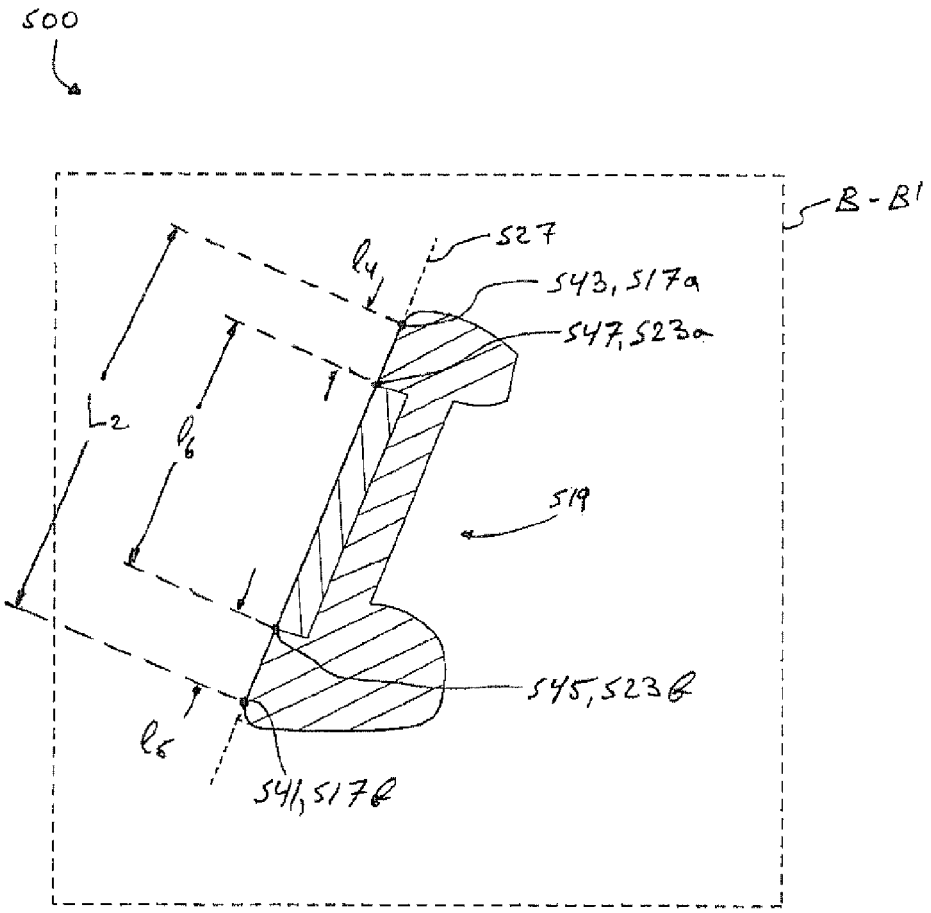

In one or more embodiments, and as depicted by way of example in FIG. 5 to FIG. 5(*b*), a golf club head 500 is a head for an iron-type golf club, but the following discussion may also be applied to a wood-type golf club. Referring to FIG. 5, the golf club head 500 has a striking face 503 that has the insert 521 disposed within the striking face 503 and a geometric center 531.

The front portion 502 of the insert 521 is generally coplanar with the striking face 503. The golf club head 500 also has a top portion 507, a bottom portion 509, a heel portion 511, a toe portion 513, a recess 518, a cavity 519, a periphery portion 515, and a hosel 525. The golf club head 500 is in the reference position relative to the ground plane 544. Vertical cross-sections A-A' and B-B' are perpendicular to the striking face plane 527 as illustrated in FIG. 5. Vertical cross-section A-A', discussed below with respect to FIG. 5(*a*), passes through a portion of the golf club head 500 at the geometric center 531. Vertical cross section B-B', discussed below with respect to FIG. 5(*b*), passes through a portion of the golf club head 500 at a location other than the geometric center 531. Unless otherwise described, these features are defined and interrelated in similar manner to the like features of the embodiments of the present invention discussed with regard to FIGS. 1(*a*)-1(*g*).

FIG. 5(*a*) is a cross-sectional view of the golf club head 500 from the perspective of vertical cross-section A-A' that passes through the geometric center 531 as illustrated in FIG. 5. The vertical cross-section A-A' intersects the golf club head 500 such that four points are created along the striking face plane 527: a point 533, a point 535, a point 537 and a point 539. The point 533 represents the point at which the striking face plane 527, the vertical cross-section A-A' and the striking face outer periphery bottom portion 517*b* meet. The point 535 represents the point at which the striking face plane 527, the vertical cross-section A-A' and the striking face outer periphery top portion 517*a* meet. The point 537 represents the point at which the striking face plane 527, the vertical cross-section A-A' and the recess outer periphery bottom portion 523*b* meet. The point 539 represents the point at which the striking face plane 527, the vertical cross-section A-A' and the recess outer periphery top portion 523*a* meet. A dimension $L_1$ represents a distance between the point 533 and the point 535. The distance $L_1$ between the point 533 and the point 535 corresponds to the overall width of the striking face 503 at the geometric center 531. A dimension $l_1$ represents the distance between the point 535 and the point 539.

In one or more embodiments, the dimension $l_1$ is no greater than 1.25 mm, no greater than 1.10 mm, or no greater than 1.00 mm. Alternatively, or in addition to the dimension $l_1$ being within these ranges, the distance between the point 533 and the point 537, which is represented by $l_2$ may be no greater than 1.25 mm, no greater than 1.10 mm, or no greater than 1.00 mm. Alternatively, or in addition to the dimensions $l_1$ and $l_2$ individually, or in combination, being within these ranges, the distance between similar points in the heel portion and toe portion of the striking face periphery portion 517 and heel portion and toe portion of the recess periphery portion 523 may be no greater than 1.25 mm, no greater than 1.10 mm, or no greater than 1.00 mm.

In one or more embodiments, it is also preferable that at least one of the ratios $l_1/L_1$ and $l_2/L_1$ is no greater than 0.050, more preferable that at least one of the ratios is no greater than 0.045, and even more preferable that at least one of the ratios is no greater than 0.040. A dimension $l_3$ represents the distance between the point 537 and the point 539. It is preferable that a ratio $l_3/L_1$ is no less than 0.90, more preferable that the ratio $l_3/L_1$ is no less than 0.95, and even more preferable that the ratio $l_3/L_1$ is no less than 0.99.

FIG. 5(*b*) is a cross-sectional view of the golf club head 500 from the perspective of vertical cross-section B-B' that passes through a portion of the golf club head 500 at a location other than the geometric center 531 as illustrated in FIG. 5. The vertical cross-section B-B' intersects the golf club head 500 such that four points are created along the striking face plane 527: a point 541, a point 543, a point 545 and a point 547. The point 541 represents the point at which the striking face plane 527, the vertical cross-section B-B' and the striking face outer periphery bottom portion 517*b* meet. The point 543 represents the point at which the striking face plane 527, the vertical cross-section B-B' and the striking face outer periphery top portion 517*a* meet. The point 545 represents the point at which the striking face plane 527, the vertical cross-section B-B' and the recess outer periphery bottom portion 523*b* meet. The point 547 represents the point at which the striking face plane 527, the vertical cross-section B-B' and the recess outer periphery top portion 523*a* meet. A dimension $L_2$ represents a distance between the point 541 and the point 543. The distance $L_2$ between the point 541 and the point 543 corresponds to the overall width of the striking face 503 at the location of the vertical cross-section B-B'. A dimension $l_4$ represents the distance between the point 543 and the point 547. The dimension $l_4$ as illustrated in FIG. 5(*b*) is greater than dimension as illustrated in FIG. 5(*a*), but $l_4$ may be greater than or equal to dimension $l_1$ depending on the geometry of the golf club head 500. The distance between point 541 and the point 545, is represented by the dimension $l_5$. The distance between the point 545 and the point 547 is represented by dimension $l_6$.

Those skilled in the art will appreciate that while the present invention has been described in association with presently preferred aspects thereof, numerous changes, modifications and substitutions of equivalents may be made therein without departing from the spirit and scope of this invention which is intended to be unlimited by the foregoing except as may appear in the following appended claims.

What is claimed is:

1. A golf club head comprising:

a main body including a top portion, a bottom portion opposite the top portion, a striking face, and a rear portion opposite the striking face, the striking face having:

a striking face plane generally coplanar with the striking face;

a striking face outer periphery coplanar with the striking face plane, the striking face outer periphery comprising an outer periphery heel portion, an outer periphery toe portion opposite the outer periphery heel portion, an outer periphery top portion, and an outer periphery bottom portion opposite the outer periphery top portion;

a recess extending rearward from the striking face plane, the recess including a recess periphery coplanar with the striking face plane;

an insert located within the recess, the insert comprising a discrete first portion and a discrete second portion such that the first portion is spaced from the recess periphery by the second portion, the first portion of the insert comprising a polymeric material and the second portion of the insert comprising a metallic material; and a minimum periphery width separating the striking face outer periphery and the recess periphery, the minimum periphery width being no greater than 1.25 mm.

2. The golf club head as recited in claim 1, wherein the periphery width is no greater than 1.1 mm.

3. The golf club head as recited in claim 1, wherein the periphery width is no greater than 1.0 mm.

4. The golf club head as recited in claim 1, wherein the insert comprises a material selected from the group consisting of: stainless steel, titanium, aluminum, copper, polymer, and a fiber reinforced polymer.

5. The golf club head as recited in claim 1, wherein the club head comprises a putter-type golf club head.

6. The golf club head as recited in claim 1, wherein the insert further comprises a front surface, a rear surface opposite the front surface, and a side surface intermediate the front surface and the rear surface, wherein the front surface is coplanar with the striking face plane.

7. The golf club head as recited in claim 1, wherein the minimum periphery width is located on one of the heel portion, the toe portion, and the top portion of the outer periphery of the striking face.

8. A putter-type golf club head comprising:

a main body including a top portion, a bottom portion opposite the top portion, a striking face, and a rear portion opposite the striking face, the striking face having:

a striking face plane generally coplanar with the striking face;

a striking face outer periphery coplanar with the striking face plane;

a recess extending rearward from the striking face plane, the recess including a recess periphery coplanar with the striking face plane; and an insert disposed within the recess, the insert comprising a discrete first portion and a discrete second portion such that the first portion is spaced from the recess periphery by the second portion, the first portion of the insert comprising a polymeric material and the second portion of the insert comprising a metallic material, wherein an imaginary plane is perpendicular to the striking face plane and passes through the recess such that:

the imaginary plane intersects the striking face outer periphery proximate the bottom portion of the main body at a first imaginary point and intersects the striking face outer periphery distal the bottom portion of the main body at a second imaginary point;

the imaginary plane intersects the recess periphery at a third imaginary point proximate the bottom portion of the main body and intersects the recess periphery at a fourth imaginary point distal the bottom portion of the main body;

the first imaginary point is spaced from the second imaginary point by a distance D;

the third imaginary point is spaced from the first imaginary point by a distance $d_1$ and the fourth imaginary point is spaced from the second imaginary point by a distance $d_2$; and at least one of a first ratio, $d_1/D$, and a second ratio, $d_2/D$, is no greater than 0.050.

9. The golf club as recited in claim 8, wherein at least one of the first ratio and the second ratio is no greater than 0.045.

10. The golf club as recited in claim 8, wherein the second ratio is no greater than 0.045.

11. The golf club as recited in claim 8, wherein the second imaginary point is spaced from the fourth imaginary point by a distance no greater than 1.25 mm.

12. The golf club head of claim 8, wherein, in the imaginary plane, the third imaginary point is spaced from the fourth imaginary point by a distance, $d_3$, such that $d_3/D$ is no less than 0.90.

13. The golf club head as recited in claim 8, wherein the insert comprises a material selected from the group consisting of: stainless steel, titanium, aluminum, copper, polymer, and a fiber reinforced polymer.

14. A golf club head comprising:

a main body including a top portion, a bottom portion opposite the top portion, a striking face, and a rear portion opposite the striking face, the striking face having:

a striking face plane generally coplanar with the striking face;

a striking face outer periphery coplanar with the striking face plane;

a recess extending rearward from the striking face plane, the recess including a recess periphery coplanar with the striking face plane; and an insert located within the recess, the insert having a front surface, a rear surface opposite the front surface, an intermediate surface between the front surface and the rear surface, a maximum length, $L_{max}$, of the front surface being coplanar with the striking face plane and having a geometric center, and the insert comprising a discrete first portion and a discrete second portion such that the first portion is spaced from the recess periphery by the second portion, wherein:

a first imaginary plane is perpendicular to the striking face plane and passes through the geometric center such that:

the first imaginary plane intersects the striking face outer periphery proximate the bottom portion of the main body at a first imaginary point and intersects the striking face outer periphery distal the bottom portion of the main body at a second imaginary point; and the first imaginary plane intersects the recess periphery at a third imaginary point proximate the bottom portion of the main body and intersects the recess periphery at a fourth imaginary point distal the bottom portion of the main body, a second imaginary plane is parallel to the first imaginary plane and spaced from the first imaginary plane by a distance between $0.10*L_{max}$ and $0.40*L_{max}$ such that:

the second imaginary plane intersects the striking face outer periphery proximate the bottom portion of the main body at a fifth imaginary point and intersects the striking face outer periphery distal the bottom portion of the main body at a sixth imaginary point; and the second imaginary plane intersects the recess periphery at a seventh imaginary point proximate the bottom portion of the main body and intersects the recess periphery at an eighth imaginary point distal the bottom portion of the main body;

the first imaginary point and the third imaginary point are spaced by a distance, $D_1$;

the second imaginary point and the fourth imaginary point are spaced by a distance, $D_2$;

the fifth imaginary point and the seventh imaginary point are spaced by a distance $D_3$;

the sixth imaginary point and the eighth imaginary point are spaced by a distance $D_4$;

at least one of $D_1$, $D_2$, $D_3$, and $D_4$ is less than or equal to 1.5 mm; and at least one of a first absolute difference between $D_1$ and $D_3$ and a second absolute difference between $D_2$ and $D_4$ is greater than or equal to 2.0 mm.

15. The golf club head as recited in claim 14, wherein the insert comprises a material selected from the group consisting of: stainless steel, titanium, aluminum, copper, polymer, and a fiber reinforced polymer.

16. The golf club head of claim 14, wherein the first portion comprises a first material and the second portion comprises a second material that is different from the first material.

* * * * *